United States Patent [19]

Bunker

[11] Patent Number: 4,936,182

[45] Date of Patent: Jun. 26, 1990

[54] SHARPING LEVER FOR A MUSICAL INSTRUMENT

[76] Inventor: Robert Bunker, P.O. Box 1011, Loveland, Colo. 80539

[21] Appl. No.: 320,939

[22] Filed: Mar. 9, 1989

[51] Int. Cl.[5] ..... G10D 1/04; G10D 3/12

[52] U.S. Cl. ..... 84/266

[58] Field of Search ..... 84/264–266

[56] References Cited

U.S. PATENT DOCUMENTS

| | | | |
|---|---|---|---|
| 3,739,680 | 6/1973 | Christiansen | 84/266 |
| 3,823,247 | 7/1974 | Bauerfeind | 84/318 |
| 3,853,030 | 12/1974 | Petutschnigg | 84/266 |
| 4,604,936 | 8/1986 | Page et al. | 84/313 |

*Primary Examiner*—Lawrence R. Franklin

*Attorney, Agent, or Firm*—Blakely, Sokoloff, Taylor & Zafman

[57] ABSTRACT

A sharping lever for shortening the length of a vibrating string on a folk harp is described. The sharping lever is mounted along the neck of the harp directly below the tuning pin which secures one end of the vibrating string. The lever includes an L-shaped mounting bracket which is attached securely to the side of the neck of the harp. The sharping lever also includes a rotatably mounted cam which contacts the string along a tip portion. The rotational movement presses the string against a fixedly mounted fret. The fret is located at a position on the mounting bracket so as to precisely define the shortened length of the vibrating string thereby raising its frequency by one-half tone.

5 Claims, 4 Drawing Sheets

"OFF" POSITION

"ON" POSITION

SHARPING LEVER FOR A MUSICAL INSTRUMENT

FIELD OF THE INVENTION

This invention relates generally to the field of musical instruments, particularly musical instruments of the harp type.

BACKGROUND OF THE INVENTION

A harp is a musical instrument with strings that vary in both thickness and length in a graduated manner. Typically, a harp consists of a body and a neck frequently referred to as a "harmonic curve" or "harmonic arch". The neck has one end connected to the upper end of the body, and the other end connected to a post which extends to the lower end of the body. The body comprises an elongated case with a top that is often referred to as a soundboard. The harp strings are secured at the lower end to a strip that is fixed centrally and axially on one or both sides of the soundboard. The other end of the harp strings are attached to a series of tuning pins located along the length of the neck which are used to tighten and stretch the strings. The pull of the strings results in vibrations of certain frequencies which are transferred to the soundboard. The frequency of vibration is determined by the length and tautness of the strings. Each is adjusted so as to yield a pleasant tone when the strings are plucked.

Of the several types of harps which are commercially available today, most share a basic dilemma in that their stringing is limited to total of eight notes per octave. These harps exclude five additional tones which are generally available on most other musical instruments. The five tones excluded on the harp encompass the commonly used sharp notes within an octave. By way of example, if one were to examine a piano, it would be most obvious that the white keys contain the common eight notes per octave, C-D-E-F-G-A-B-C; also frequently referred to as the natural notes. The black keys on a piano keyboard located between notes C–D, D–E, F–G, G–A, A–B, are not available on most harps. These black keys within an octave on a piano comprise the notes C#, D#, F#, G# and A#. Thus, while there are thirteen pitches in the chromatic scale—eight natural notes and five sharp notes—most conventional harps only encompass the eight natural notes. (This conventional type of harp is generally considered a diatonic instrument, meaning the scale encompasses only the notes C, D, E, F, G, A, B, C and not the complete thirteen notes of the Western Musical Scale.)

Historically, the reason why most harps contain eight rather than thirteen notes in an octave relates to the physical constraints of performing. The keys of a piano are designed so that a pianist can stretch his fingers with a reasonable effort to encompass an entire octave on the piano. This allows a complete cord to be played with a single movement of the hand. The harp was arranged similarly in that it is physically possible for a hand to play a complete cord spanning an entire octave. However, in order to accomplish this, five strings had to be removed from the string band. The piano keyboard has the advantage of having keys located between the notes of the diatonic scale. This minimizes the length of the scale. On the other hand, in order to be played in complete cords, the harp had to have certain strings removed; (i.e., those associated with the sharp notes).

To compensate for this shortcoming, the five missing pitches of the harp are produced by altering the vibrating length of any of the eight existing strings in the octave. Most often, the strings are altered by shortening their vibrating length by means of a sharping device which contacts the strings at a precise location. Ideally, the device should hold the string in a firm and stable position—shortening its vibrating length without consuming the strings entire vibration. Such a device would ideally transfer the entire vibration of the string, into the harps soundboard.

This sharping device should also lock into position at a very precise distance from the bridge pin (the bridge pin is located on the neck and is used to exactly define the length of each string) calculated by multiplying the strings vibrating length by a factor of 0.0555. This distance represents the precise position that the sharping device must be located in order to alter the pitch of the string one-half step higher than its original pitch, (e.g., from C to C#).

In the prior art, there have been two basic ways of implementing a sharping device, leading to two different categories of instruments. One category of instrument is referred to as a pedal harp and the other is called a folk harp.

In a pedal harp, a series of pedals with various positions are mounted on the base of the instrument and resiliently returned by springs. When a pedal is depressed, a series of rods and linkages move a forked device which twists the strings in a sufficient manner so as to create a note of vibration which is raised by one-half pitch from that of the normal string. A major disadvantage of the pedal harp is the complexity of its transmission of movement and the enormous number of small mechanical parts involved. This complexity is reflected in a high purchase price and costly repairs. A further disadvantage is the operating noise caused when the many parts are set in motion. An example of this type of harp is disclosed in U.S. Pat. No. 4,599,931.

Among folk harps, there have been numerous prior art sharping levers developed, each with their own set of drawbacks.

One very basic type of sharping lever is known as a blade or hook lever. This simple device is mounted into the neck of the harp by means of a straight circular shaft press-fitted into a hole between each string. A cam is located on the exposed end of the shaft and, in its "off" or natural position, is positioned parallel to the strings. When turned, the cam's position is shifted so that it contacts the string and displaces it in one direction; thereby shortening its vibrating length. One common problem with this device is that the cam is often turned too far or too little producing a sound that is out of tune with the existing scale surrounding it. Furthermore, in order for this device to function properly, the string must be displaced a considerable distance from its original position. This repositioning of the harp string creates distortion in the usual string spacing, making it uncomfortable for certain harpists.

Another drawback of the hook or blade lever is that if the cam contact point is not absolutely perpendicular to the string, the string tension will force the cam to rotate back to its "off" position. Yet another disadvantage of this device is that for a complete rotation of the cam from an "off" to an "on" position, the cam must slide along the string for a distance of approximately $\frac{3}{8}$ of an inch. Since the string is typically made of a delicate material, such as nylon or gut, this sliding action abrasively wears through the softer string material and shortens its useful life.

Another prior art sharping lever uses a rotating cam riveted to a mounting bracket, which itself is secured to the harp by two screws. This device has a circular cam plate with a handle molded into the plate and a graduated edge. This edge contacts the string when the cam is rotated from the "off" to the "on" position. In the "on" position, the string is displaced to one side and sounds one semi-tone higher.

This circular cam lever has several drawbacks. First of all, the cam tends to wear a path or groove into the contact location of the string. Consequently, the strings wear out rapidly. Also, because the string is applying a great deal of lateral pressure to the cam, the lever's mounting bracket requires two screws to securely fasten the lever to the neck. These screws occupy alot of area on the harp neck, making installation a problem.

Another problem with this type of device is that the string must be displaced a substantial distance to produce a reasonable tone. The cam shifts the location of each string closer to the adjacent string on one side, and further away from the adjacent string on the opposite side. Again, this can make the harp awkward to play.

Yet another disadvantage of this device is that the cam contacts the string in the direction of its vibrating motion. That is, contact is made in a direction parallel to the plane of the string band. This directional contact often results in string "buzzing", frequently referred to as "zinkering". Thus, good tone is difficult to achieve.

Another type of prior art lever is produced by Lyon and Healy Harps of Chicago, Illinois. The Lyon and Healy lever comprises a mounting bracket which is hinged to a handle having a v-groove cut into it approximately at a distance one-half of its total length. The v-groove contacts the string in mid-motion and slides along the string until it stabilizes it at its highest point slightly above perpendicular.

This lever has a number of disadvantages. Firstly, it wears out the strings rapidly because the distance from pivot center to cam edge is a large radius causing an enormous swing to the cam. This radial swing wears a long path into the contact area of the string. Secondly, for tonal reasons the handle and v-groove is usually cast of a metal material such as brass. Metal produces the most damage to the string because of its hard, resilient nature. Thirdly, this lever displaces the individual strings in a direction away from the plane of the string-band. This displacement presents certain difficulties in playing, as previously discussed. Finally, this type of lever provides only one-point contact. One-point contact systems are characterized by a sound that is dulled radically when the lever is applied to the string.

Another prior art sharping lever is one manufactured by Robinson's Harp Shop of Mt. Laguna, California. It is similar to the Lyon and Healy lever in that its motion originates from under the string and pivots outward, pushing the string out of alignment. The cam of the Robinson lever includes a brass dowel with a turned groove to accept the string. This pin is mounted slightly off center of the brass handle plate, which itself is riveted onto a mounting L-bracket.

Among the drawbacks associated with the Robinson lever include all of those discussed above in connection with that the Lyon and Harp lever. Additionally, the turned groove is, under certain conditions, an inadequate means for holding the string in place. With a sufficiently firm stroke, the string may dislodge—producing a zinkered sound. A further drawback of this lever is that the cam handle is secured on the mounting bracket by a rivet. The riveting process is, by its nature, somewhat unpredictable—causing some handles to be overly stiff while others are far too loose to stay in their proper position.

Lastly among the prior art levers is one built by Salvi Harps. This lever consists of a cam bracket which is located on the neck harp via three fasteners which keep it from rotating when applied. The cam itself is a modified version of the circular cam previously discussed. It consists of two lobes that squeeze the string in opposite directions simultaneously when rotated. This design provides a very firm hold on the string which eliminates zinkering. However, the Salvi lever has a disadvantage in that the two-lobe, pinching approach results in damage to the harp strings over time. Another drawback is that the cam is riveted to the bracket. Riveting, as discussed above, occasionally produces a handle which is either secured too tight or too loose. Finally, the three screws required to mount the cam on the harp neck make installation and tuning cumbersome.

Given the drawbacks associated with each of the prior art sharping levers, there still remains a great need for a low cost alternative to the pedal harp. As will be seen, the present invention provides a sharping lever which can be cheaply produced and which overcomes each of the problems discussed above.

Accordingly, the object of the invention is to remedy the various disadvantages of the prior art by providing a simple, low-cost mechanism which stresses each string by a minimum fixed value.

A further object of the present invention is to provide a lever which overcomes the problem of excessive string deterioration while maintaining stable contact with the string, thereby eliminating zinkering. Moreover, the present invention achieves these objectives with minimal rotational movement and without excessive string displacement.

Another object of the sharping lever of the present invention is to provide adjustable, non-riveted handles which are both accurate and comfortable to use.

Yet another object of the present invention is to provide a sharping lever which provides two-point contact with the string to produce a superior tone.

Other prior art known to Applicant include U.S. Pat. No. 4,126,074 of Lundquist, entitled "Violin Harp"; U.S. Pat. No. 4,348,934 of Ogata, entitled "Tuning Device for String Musical Instruments"; U.S. Pat. No. 4,796,504 of McWillis, entitled "Musical Instrument"; and U.S. Pat. No. 4,637,290 of Grawi, entitled "Variable Pitch Harp".

SUMMARY OF THE INVENTION

A sharping lever for shortening the length of a vibrating harp string is disclosed. The length of the string is ordinarily defined by a bridge pin attached along the neck of the harp and a soundboard which comprises a portion of the harp case or body. The mounting lever is securely attached along the side of the neck directly below the bridge pin. The sharping lever includes a fret which is securely mounted along the neck of the harp adjacent to the harp string and a means for contacting the harp string at a point between the fret and the bridge pin and for pressing the harp string against the fret to produce a shortened length. The shortened length is defined by the fret and the soundboard.

The means for contacting and pressing the harp string comprise a cam rotatably mounted to an L-shaped bracket which is itself secured to the neck. The cam has a tip member and a handle, the tip member contacting and pressing the harp string in response to the rotational movement of the handle. In addition, the tip of the cam is grooved to hold the harp strings firmly in place. The sharping lever of the present invention provides two-point contact to the string thereby producing an excellent sound tone.

DETAILED DESCRIPTION OF THE INVENTION

Figure 1A:
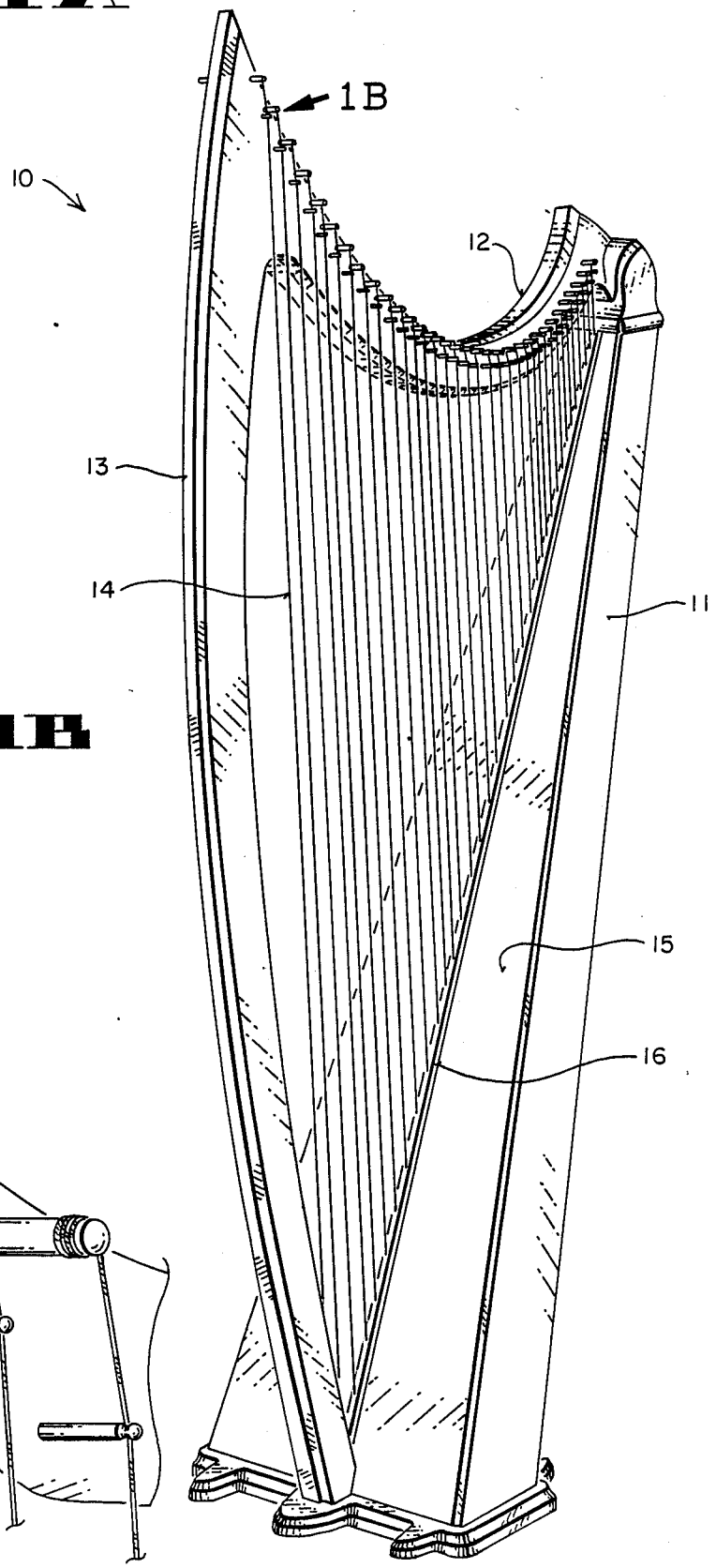
FIG. 1*a* is a perspective view of a harp.
Figure 1B:
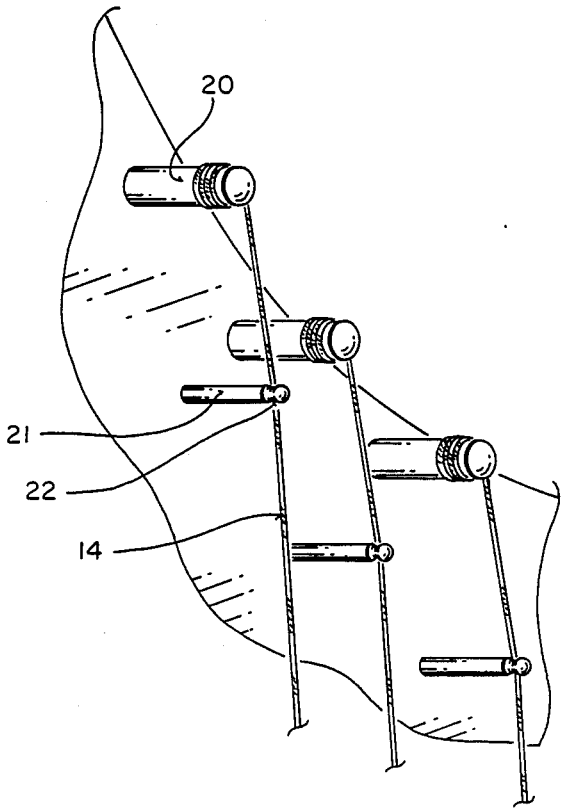
FIG. 1*b* is a magnified perspective view of a portion of the neck of a harp.

Referring to FIGS. 1*a* and 1*b*, there is shown a harp 10 formed as usual with a body 11, a neck or arch 12 and a post 13. The top of the body comprises a soundboard 15. As usual, strings, such as 14 are stretched between the neck 12 and the longitudinal axis of soundboard 15 running from the base end up to the treble end located near the neck 12. The strings are secured to the soundboard along a narrow hardwood strip 16 which is secured centrally on the surface of soundboard 15. Each string is attached to a tuning pin 20 located along the top portion of neck 12. String 14 is coiled around tuning pin 20 to provide the proper tension for the particular string. The length of the string is ordinarily defined as being between the hardwood strip 16 located on soundboard 15 and a bridge pin 21. Bridge pin 21 has located near its tip a tapered groove 22 over which string 14 is pressed to precisely define the vibrating length of string 14. If desired, a sharping lever would be mounted directly below bridge pin 21 for each string of the stringband.

Figure 2:
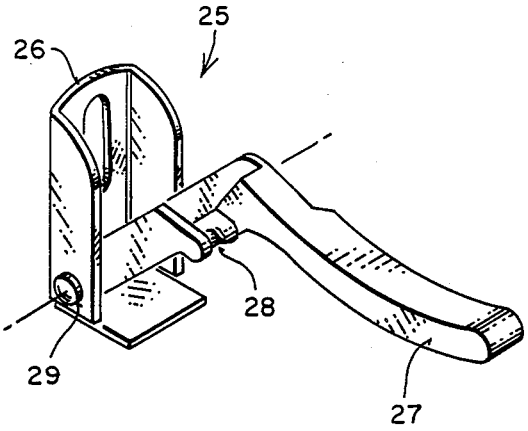
FIG. 2 (PRIOR ART)
FIGS. 2–5 show perspective views of various prior art sharping levers.

FIGS. 2–5 show several prior art sharping levers, each of which has been previously discussed in the background of the invention. For instance, FIG. 2 shows a sharping lever 25 manufactured by Lyon and Healy Harps of Chicago, Illinois. This lever comprises a mounting bracket 26 which is attached to the string side of neck 12. To turn the lever to the "on" position (i.e., to sharpen the tone of the string by one-half note), handle 27 is pulled up, rotating tip 28 around pivot point 29 until tip 28 contacts the string at the correct position.

Figure 3:
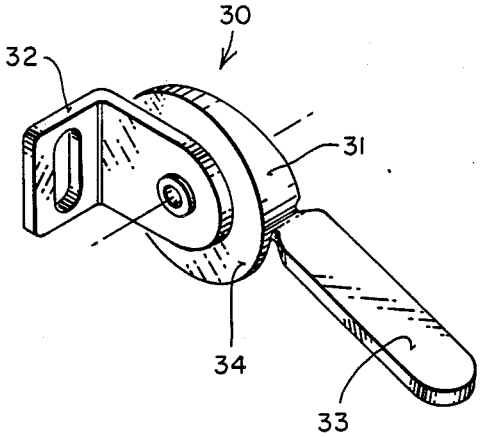
FIG. 3 (PRIOR ART)

FIG. 3 shows another prior art sharping lever 30 comprising a circular cam 34 riveted to a mounting bracket 32. Lever 30 also comprises a graduated flange, or edge, 31 located along the outer edge of circular disk 34. When handle 33 is lifted, the wide portion of edge 31 comes in contact with string 14. The cam shifts the location of each string closer to the adjacent string on one side and further away from the other adjacent string on the opposite side.

Figure 4:
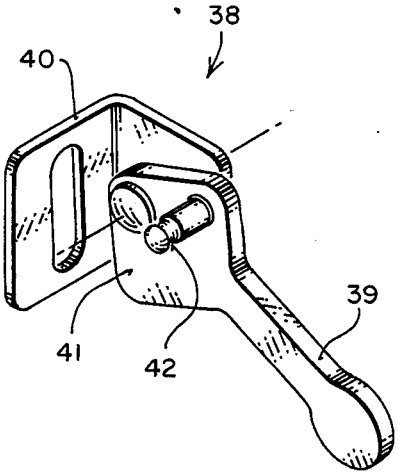
FIG. 4 (PRIOR ART)

FIG. 4 shows a prior art sharping lever 38 previously referred to as the Robinson lever. Cam 41 includes a brass dowel with a turned groove 42 used to accept the string. Mounting bracket 40 is attached to the side of neck 12 directly below the bridge-pin. Handle 39 is raised or lowered to turn the sharping lever "on" or "off".

Figure 5:
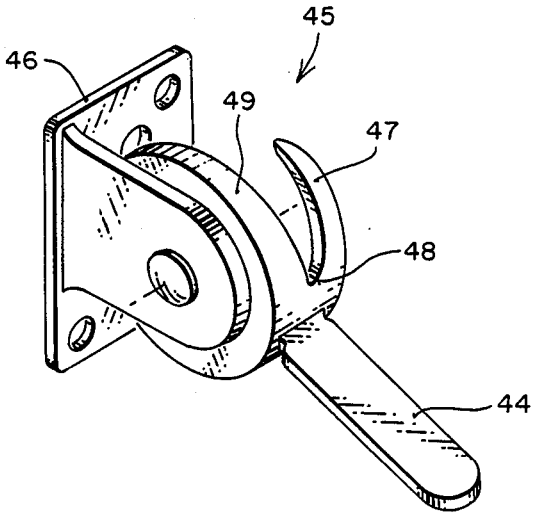
FIG. 5 (PRIOR ART)
Figure 6:
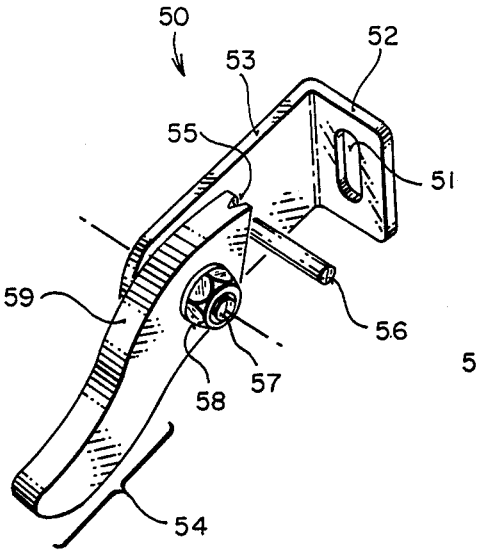
FIG. 6 is a perspective view of the currently preferred embodiment of the present invention.
Figure 7:
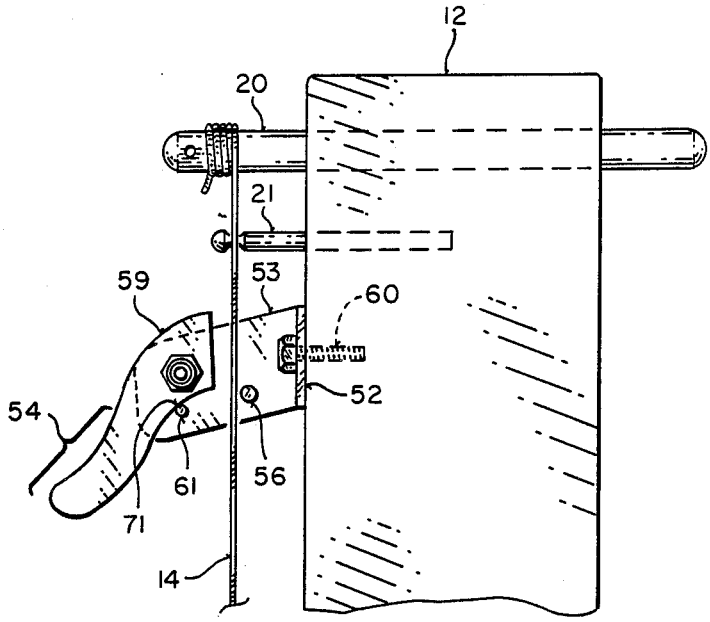
FIG. 7 is a side view of the present invention shown in the "off" position and mounted along the side of the neck of the harp.

FIG. 5 shows a prior art sharping lever 45, known as the Salvi lever. Lever 45 has a circular cam with a graduated edge or flange 49. The cam is attached to a mounting bracket 46. Unlike cam 30 of FIG. 3, mounting lever 45 also includes additional lobe 47 which joins with graduated edge 49 at the end of slot 48. In operating this lever, handle 44 is lifted until string 14 is pinched by the protruding cam on one side and lobe 47 on the other.

All the problems and drawbacks associated with each of these prior art sharping levers have been discussed in detail in the foregoing sections of this application. These problems include excessive string deterioration, uneven handle movement, "zinkering" of the strings by over plucking, non-adjustable riveted handles, insufficient one-point contact with the string, handles which are uncomfortable to operate, excessive string displacement, and untrue pitch alterations due to overrotation in the cam.

Referring now to FIGS. 6–10, several views of the sharping lever of the currently preferred embodiment of the present invention are shown. Sharping lever 50 comprises an L-shaped bracket 53 which includes a section 70, having a slot 51 for mounting the bracket against the neck, and a section 69 for mounting the cam. As can be seen from FIGS. 6–10, section 69 is generally perpendicular to mounting portion 70. Although not required for proper operation, portion 69 is angled downward by approximately 10°–20° to allow easy adjustments in the fret height via slot 51 and screw 60. The angle also allows mounting screw 60 to be located higher up on the neck to accomodate harps having small neck surfaces.

Bracket 53 is ordinarily machined from a hard metal such as brass or steel; alternatively a hard plastic may be used. When attached to neck 12, surface 52 is mounted flushly against the string side of neck 12. Bracket 53 is secured to the neck by using a threaded screw 60 which passes through slot 51. Slot 51 is elongated to permit tonal adjustments according to the position of bracket 53 relative to pin 21. When sharping lever 50 is in the "on" position, the force or resistance exerted by the string on the lever is directed normal (i.e., perpendicular) to the neck attachment surface. Because the force is perpendicular, and not parallel as in most prior art sharping levers, only one screw is required to secure lever 50 to the neck. In those levers that force the string parallel to the neck surface, the pressure tends to rotate the lever—consequently two or more screws are needed to secure the bracket to the neck.

Extending outward from section 69 of bracket 53 are three cylindrically shaped studs. These include fret 56, cam shaft 57 and cam stop 61. In the preferred embodiment, each of these cylindrical shafts comprise a stainless steel self-clinching stud which is press-fit into holes located along the side of bracket 53. This press-fit method provides a secure bonding means by which each shaft is attached to mounting bracket 53. (The self-clinching studs are manufactured by PEM, Inc.)

Figure 9:
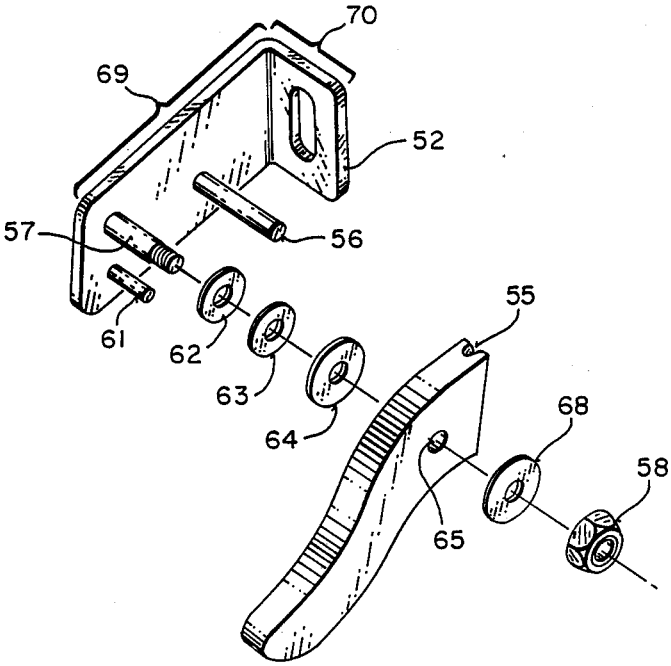
FIG. 9 is an exploded view showing the individual components parts forming the sharping lever of the present invention.
Figure 10:
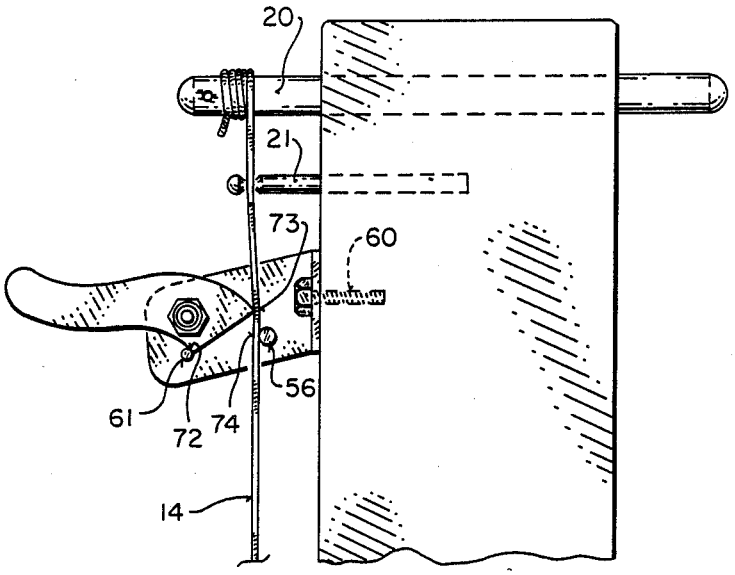
FIG. 10 is a side view of the present invention as mounted along the side of the neck of the harp and rotated to the "on" position.

Cam shaft 57 extends perpendicularly outward from section 69 of mounting bracket 53. As can be seen in FIG. 9, approximately half of the length of cam shaft 57 is threaded. The diameter of the shaft in the preferred embodiment is 0.120 inches, while the thread size matches standard screw size 5–40. The maximum diameter of the thread is equal to 0.120, or approximately the diameter of the shaft.

Cam 59 is molded of a high lubricity plastic, such as Debrin II. It also includes a hole 656 which matches the diameter of cam shaft 57 (i.e, 0.120 inches). When assembled, cam 59 is pressed onto cam shaft far enough to center it on the unthreaded portion of cam shaft 57. A snug fit is maintained by matching the size of hole 65 with the diameter of cam shaft 57. Since cam 59 is molded of a high lubricity plastic, cam 59 may be rotated gently and smoothly around cam shaft 57 without slippage or sticking.

Cam 59 also includes a handle 54 and a tip 55. The shape of the cam handle is a gentle flowing curve that is contoured to fit the shape of the harpists' thumb and forefingers—providing comfortable movement. Tip 55 is machined with a gradually receding groove which matches the diameter of string 14. As will be discussed in more detail later, when the cam is turned or rotated to an "on" position, tip 55 of cam 59 contacts the string and presses it against fret 56. This firm contact is essential for an excellent tone and also for eliminating any possibility of zinkering.

The groove at cam tip 55 is made just wide enough to provide a secure grip on string 14 when cam 59 is rotated. Ordinarily, the width of this graduated groove matches the diameter of string 14. With harp string 14 securely held by grooved tip 55, the harpist may aggressively pluck the string without producing a buzzing or zinkering tone.

One key aspect of the present invention is the two-point contact system manifested by lever 50. As can be most easily seen in FIG. 10, when cam 59 is rotated to an "on" position tip 55 contacts the string at point 73, which is located between fret 56 and bridge pin 21. The exact location of contact point 73 varies according to the size of the cam and the spacing of the cam shaft relative to the fret 56. After contact by tip 55, string 14 is pressed against fret 56 until a second contact point is established at location 74. This two-point method creates a very firm contact between string 14 and fret 56. Using this method, the string displacement is minimal—the strings being bent only slightly over the particular fret.

Referring now to FIG. 9, an exploded view of the sharping lever device of the present invention is shown. Positioned between the side surface of cam 59 and plate portion 69 of L-bracket 53 are a plurality of spacing and tensioning washers. Washers 62–64 provide a means for spacing from the cam an adequate distance from the surface of bracket 53. They also provide tension or pressure against the side of cam 59. This adjustable tension insures that cam 59 will not be easily rotated (e.g., slippage) without the aid of the harpist. Washers 62 and 63 comprise Belleville spring washers while washer 64 is an ordinary single brass flat washer. When assembled, cam 59 is nested between the outer nylon washer 68 and the inner spring bed consisting of washer 62–64. The entire assembly is secured by nut 58, which also provides a means of tension adjustment. This capability eliminates the possibility of a handle becoming too tight or too loose for easy, fluid rotation. In the preferred embodiment, nut 58 comprises a self-locking Nylock nut.

Figure 8:
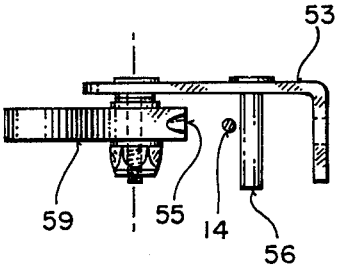
FIG. 8 is a top view of the present invention.

Referring now in to FIG. 8, a top view of the sharping lever is shown. As can be seen from FIG. 8, the combination of washers 62–64 provide a spacing between cam 59 and mounting bracket 53. This spacing directly aligns tip 55 to string 14. (The mounting bracket typically is mounted such that plate portion 69 of bracket 53 is sufficiently far from string 14 so that it will never contact string 14 no matter how hard the harpist plucks the string.) Because the plane of vibration of string 14 is parallel to the shaft of fret 56 is ordinarily positioned close to string 14. In general, the closer fret 56 is to string 14, the less displacement that is required of string 14 during sharping. Most often, fret 56 is positioned such that it rarely contacts string 14 during normal playing (i.e., when the sharping lever is in the "off" position.) The distance between the side surface of neck 12 and string 14 is defined by bridge pin 21. This latter distance is used to determine the relative position of fret 56 to section 70 of the bracket.

To operate sharping lever 50 the harpist merely raises the cam handle 54 in an approximate 35° arc, stopping at a position of approximately ten o'clock. The cam tip 55 contacts the strip about the mid-point of its rotation, at which time it begins to displace the string. The second half of the rotation presses the string firmly against fret 56.

Sharping lever 50 also includes a stop pin 61 located directly below cam shaft 59. This stop pin has two basic functions. In the "off" position, stop 61 contacts the underside of cam 59 at point 71 (see FIG. 7). This prevents the cam from over rotating whereby handle 54 would contact string 14. When rotated to the "on" position, stop 61 acts to contact the underside of cam 59 at point 72 (see FIG. 10) thereby preventing overrotation of the cam and insuring that string 14 is displaced by the minimal distance required for excellent tone. Thus, stop pin 61 prevents overrotation of cam 59 in both directions.

It is appreciated that the relative positions and spacings of cam shaft 57, fret 56 and stop pin 61 may vary or be adjusted depending on the particular size of the cam, the distance of the string to the neck surface, or the physical dimensions of the mounting bracket, without detracting from the spirit or scope of the present invention. All that is required is then when cam 59 is rotated to its "on" position, lever 50 contacts the string in two points as previously discussed, (i.e., at tip 55 and fret 56). In the currently preferred embodiment, fret 56 is located 0.515 inches away from the center of cam shaft 57 and 0.515 inches away from stop pin 61. Stop pin 61 is located directly beneath cam shaft by 0.25 inches. Additionally, the height of mounting bracket 53 is 0.67 inches and slot 51 has a length of 0.136 inches. Slot 51 allows vertical adjustment of the mounting bracket along the side of neck 12 to precisely define the sharpened tone (i.e., such that fret 56 contacts the string thereby shortening it vibrating length by a factor of 0.0555).

Thus, a sharping lever for use in a musical instrument has been described.

I claim:

1. An apparatus for shortening the vibrating length of a harp string comprising:

a bracket;

a cam shaft securely attached to said bracket;

a fret member having a cylindrical surface said fret being securely attached to said bracket and positioned away from said cam shaft;

mounting means for attaching said bracket along the neck of the harp such that said harp string is positioned between said cam shaft and said fret, the plane of vibration of said harp string being generally parallel to said fret;

a cam rotatably mounted on said cam shaft, said cam having a grooved tip member which securely holds and presses said harp string against said cylindrical surface of said fret when said cam is rotated, thereby shortening said vibrating length of said harp string; and a stop pin for halting the rotation of said cam to prevent excessive tension from developing in said harp string.

2. The apparatus of claim 1 wherein said grooved tip comprises a high lubricity plastic material to minimize the war on said harp string.

3. An apparatus for shortening the vibrating length of a harp string comprising:

an L-shaped bracket having a slotted first surface mounted to the neck of the harp and a second surface perpendicular to said first surface;

a cam shaft securely attached to said bracket and perpendicular to said second surface;

a fret having a cylindrical surface said fret being securely attached to said bracket and positioned perpendicular to said second surface, said fret also being spaced apart from said cam shaft and generally parallel to the plane to vibration of said harp string, said bracket being mounted such that said harp string is located between said cam shaft and said fret, said harp string being closer to said fret than to said cam shaft;

a cam rotatably mounted on said cam shaft, said cam having an elongated handle located at one end of said cam and a grooved tip located at the opposite end of said cam such that rotation of said cam by said handle causes said grooved tip to contact and hold said harp string at a point between the bridging pin and said fret, continued rotation of said cam causing said harp string to be pressed against said cylindrical surface of said fret, said cam further comprising a high lubricity plastic material to minimize the wear on said harp string; and a stop pin securely mounted to said second surface of said bracket effective to half the rotation of said cam after said tip presses said harp string against said fret.

4. The apparatus of claim 3 further comprising a screw threaded into said neck through said slotted first surface to fasten said first surface of said bracket flushly against said neck and to facilitate vertical adjustment of said bracket along said neck.

5. The apparatus of claim 4 wherein said stop pin, said fret and said cam shaft are integrally attached to said bracket.

* * * * *